US010844464B1

(12) United States Patent
Garside et al.

(10) Patent No.: US 10,844,464 B1
(45) Date of Patent: Nov. 24, 2020

(54) NIOBIUM METAL ALLOY

(71) Applicant: Space Exploration Technologies Corp., Hawthorne, CA (US)

(72) Inventors: Gavin J. Garside, Hawthorne, CA (US); Kevin A. Lohner, Hawthorne, CA (US); Meagan R. Slater, Hawthorne, CA (US); Charles Kuehmann, Hawthorne, CA (US); David R. Snyder, Evanston, IL (US); Jason T. Sebastian, Evanston, IL (US); Gregory B. Olson, Evanston, IL (US)

(73) Assignee: Space Exploration Technologies Corp., Hawthorne, CA (US)

( * ) Notice: Subject to any disclaimer, the term of this patent is extended or adjusted under 35 U.S.C. 154(b) by 159 days.

(21) Appl. No.: 15/953,137

(22) Filed: Apr. 13, 2018

Related U.S. Application Data

(60) Provisional application No. 62/485,919, filed on Apr. 15, 2017.

(51) Int. Cl.
*C22C 27/02* (2006.01)
*C22F 1/18* (2006.01)

(52) U.S. Cl.
CPC ..... *C22C 27/02* (2013.01); *C22F 1/18* (2013.01)

(58) Field of Classification Search
CPC ..... C22C 1/18; C22C 27/02; C22F 1/18
See application file for complete search history.

(56) References Cited

U.S. PATENT DOCUMENTS 4,836,849 A 6/1989 Svedberg et al.

FOREIGN PATENT DOCUMENTS

GB 1181211 A * 2/1970 ..... C22C 27/02

OTHER PUBLICATIONS

Begley, R.T., et al., "Development of Niobium-Base Alloys," Research Laboratories, Westinghouse Electric Corporation, WADC Technical Report 57-344, Part V, Sep. 1961, 146 pages.

Dickinson, J.M., "The Niobium-Thorium and the Niobium-Vanadium Alloy Systems," Doctoral Dissertation, Iowa State College, 1953, 104 pages.

Olson, G.B., et al., "Quest for Noburnium: 1300C Cyberalloy," Niobium for High Temperature Applications, Proceedings of the International Symposium on Niobium for High Temperature Applications, Dec. 1-3, 2003, Araxa, Brazil, published Dec. 2004, pp. 113-122.

Roche, T.K., "Evaluation of Niobium-Vanadium Alloys for Application in High-Temperature Reactor Systems," Oak Ridge National Laboratory operated by Union Carbide Corporation for the U.S. Atomic Energy Commission, Oct. 1965, 39 pages.

Schmidt, F.F., and H.R. Ogden, "The Engineering Properties of Columbium and Columbium Alloys," Defense Metals Information Center, Battelle Memorial Institute, DMIC Report 188, Sep. 1963, 247 pages.

Tanaka, R., et al., "Newly Developed Niobium-Based Superalloys for Elevated Temperature Application," Niobium for High Temperature Applications, Proceedings of the International Symposium on Niobium for High Temperature Applications, Dec. 1-3, 2003, Araxa, Brazil, published Dec. 2004, pp. 89-98.

Tavassoli, A.A., "Development of Columbium Alloy WC3015," George C. Marshall Space Flight Center, Msarshall Space Flighter Center, Alabama, NASA Technical Note, NASA TN D-6390, Jul. 1971, 29 pages.

* cited by examiner

*Primary Examiner* — Jessee R Roe
(74) *Attorney, Agent, or Firm* — Polsinelli PC

(57) ABSTRACT

In one embodiment of the present disclosure, a niobium metal alloy composition includes: a vanadium content in the range of about 1.5 to about 12 weight percent; a hafnium content in the range of about 5 to about 13 weight percent; a titanium or zirconium content or a mixture of titanium and zirconium content in the range of about 0.25 to about 2.5 weight percent; and a niobium content as a balance of the alloy.

18 Claims, 11 Drawing Sheets

| ID | Notes | Chemistry W | V | Nb | Zr | Ti | Mo | Hf | TGA Final Mass% |
|---|---|---|---|---|---|---|---|---|---|
| 15 | VirginCp03 | | | 89.0 | | 1.0 | | 10.0 | 140.1 |
| ATI Control 3 | | | | 89.0 | | 1.0 | | 10.0 | 137.6 |
| ATI Control 2 | | | | 89.0 | | 1.0 | | 10.0 | 137.4 |
| ATI Control 1 | | | | 89.0 | | 1.0 | | 10.0 | 136.5 |
| 9 | | 4.0 | 1.0 | 94.2 | 0.8 | | | | 131.5 |
| 5 | | 7.0 | 7.0 | 85.2 | 0.8 | | | | 128.0 |
| 2 | | 1.0 | 1.0 | 97.2 | 0.8 | | | | 126.2 |
| 18 | Cb752 | 10.0 | | 87.5 | 2.5 | | | | 125.8 |
| 12 | | 4.0 | 1.0 | 93.0 | 2.0 | | | | 124.8 |
| 10 | | 4.0 | 7.0 | 88.2 | 0.8 | | | | 120.4 |
| 4 | | 7.0 | 1.0 | 91.2 | 0.8 | | | | 119.9 |
| 8 | | 7.0 | 4.0 | 88.2 | 0.8 | | | | 117.6 |
| 3 | | 1.0 | 7.0 | 91.2 | 0.8 | | | | 115.6 |
| 17 | B33 | | 5.0 | 95.0 | | | | | 115.1 |
| 11 | | 4.0 | 4.0 | 90.0 | 2.0 | | | | 113.6 |
| 20 | Duplicate | 4.0 | 4.0 | 91.2 | 0.8 | | | | 111.8 |
| 13 | | 1.0 | 4.0 | 93.0 | 2.0 | | | | 111.8 |
| 7 | | 1.0 | 4.0 | 94.2 | 0.8 | | | | 111.1 |
| 14 | B66 | | 5.0 | 89.0 | 1.0 | | 5.0 | | 110.6 |
| 6 | Duplicate | 4.0 | 4.0 | 91.2 | 0.8 | | | | 108.2 |

| Button ID | Nb | Hf | V | W | Zr | Ti | Mo | TGA Final Mass/% |
|---|---|---|---|---|---|---|---|---|
| 15 | 89.0 | 10.0 | | | | 1.0 | | 139.3 |
| 1 | 86.7 | 5.6 | 1.9 | 2.9 | 2.9 | | | 138.7 |
| 2 | 85.6 | 9.3 | 2.3 | 2.3 | 0.5 | | | 131.8 |
| 4 | 83.5 | 10.0 | 1.7 | 3.8 | | 1.0 | | 129.9 |
| 3 | 83.3 | 9.1 | 1.0 | 3.8 | 2.8 | | | 128.6 |
| 5 | 85.2 | 9.5 | 3.8 | | 0.5 | | 1.0 | 120.4 |
| 6 | 84.4 | 9.6 | 5.5 | | | | 0.5 | 118.6 |
| 14 | 89.0 | 10.0 | | | | 1.0 | | 118.5 |
| 12 | 81.3 | 10.6 | 7.0 | | | 1.1 | | 118.5 |
| 13 | 81.3 | 10.6 | 7.0 | | | 1.1 | | 116.9 |
| 8 | 81.3 | 10.6 | 7.0 | | | 1.1 | | 116.2 |
| 11 | 83.3 | 9.4 | 4.5 | 2.3 | 0.5 | | | 114.8 |
| 9 | 87.4 | 9.4 | 2.7 | | 0.5 | | | 114.7 |
| 7 | 85.0 | 10.3 | 3.7 | | | 1.0 | | 114.2 |
| 10 | 84.4 | 9.6 | 5.5 | | 0.5 | | | 112.9 |

NIOBIUM METAL ALLOY

CROSS-REFERENCE TO RELATED APPLICATION

This application claims the benefit of U.S. Provisional Application No. 62/485,919, filed Apr. 15, 2017, the disclosure of which is hereby expressly incorporated by reference herein in its entirety.

BACKGROUND

C-103 niobium alloy (which is 89% Nb, 10% Hf and 1% Ti) is commonly used in high-performance, lightweight, space propulsion systems. C-103 niobium alloy has capability to withstand high stress levels at elevated temperatures and also has a low ductile-to-brittle transition temperature for withstanding high frequency vibrations at cryogenic temperatures. C-103 niobium alloy also has desirable properties for fabricating and welding.

Despite the advantages of C-103 niobium alloy, there exists a need for improved niobium alloys allowing lower part weight and improved operating temperature yield strength.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a niobium metal alloy composition in provided. The niobium metal alloy composition includes: a vanadium content in the range of about 1.5 to about 12 weight percent; a hafnium content in the range of about 5 to about 13 weight percent; a titanium or zirconium content or a mixture of titanium and zirconium content in the range of about 0.25 to about 2.5 weight percent; and a niobium content as a balance of the alloy.

In accordance with another embodiment of the present disclosure, a niobium metal alloy composition in provided. The niobium metal alloy composition consists of: a vanadium content in the range of about 1.5 to about 12 weight percent; a hafnium content in the range of about 5 to about 13 weight percent; a titanium or zirconium content or a mixture of titanium and zirconium content in the range of about 0.25 to about 2.5 weight percent; and a niobium content as a balance of the alloy.

In any of the embodiments described herein, the niobium content may be in a range selected from the group consisting of about 70 to about 90 weight percent and about 77 to about 85 weight percent.

In any of the embodiments described herein, the vanadium content may be in a range selected from the group consisting of about 2 to about 12 percent, about 5 to about 12 weight percent, greater-than-5 to about 12 weight percent, and greater-than-5 to about 9 weight percent.

In any of the embodiments described herein, the hafnium content may be in a range selected from the group consisting of greater-than-5 to about 13 weight percent and about 8 to about 13 weight percent.

In any of the embodiments described herein, the titanium or zirconium content or a mixture of titanium and zirconium content may be in a range selected from the group consisting of about 0.5 to about 2.0 weight percent and about 0.7 to about 1.5 weight percent.

In any of the embodiments described herein, the composition may further include another alloying metal selected from the group consisting of tungsten, molybdenum, tantalum, rhenium, and combinations thereof.

In any of the embodiments described herein, the alloy may have a ductile-brittle transition temperature of less than −196° C. (−321° F.).

In any of the embodiments described herein, the alloy may have a specific yield strength at 2000° F. of greater than 90 ksi/lb/in3.

In any of the embodiments described herein, the alloy may have a specific yield strength at 2000° F. of greater than 100 ksi/lb/in3.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
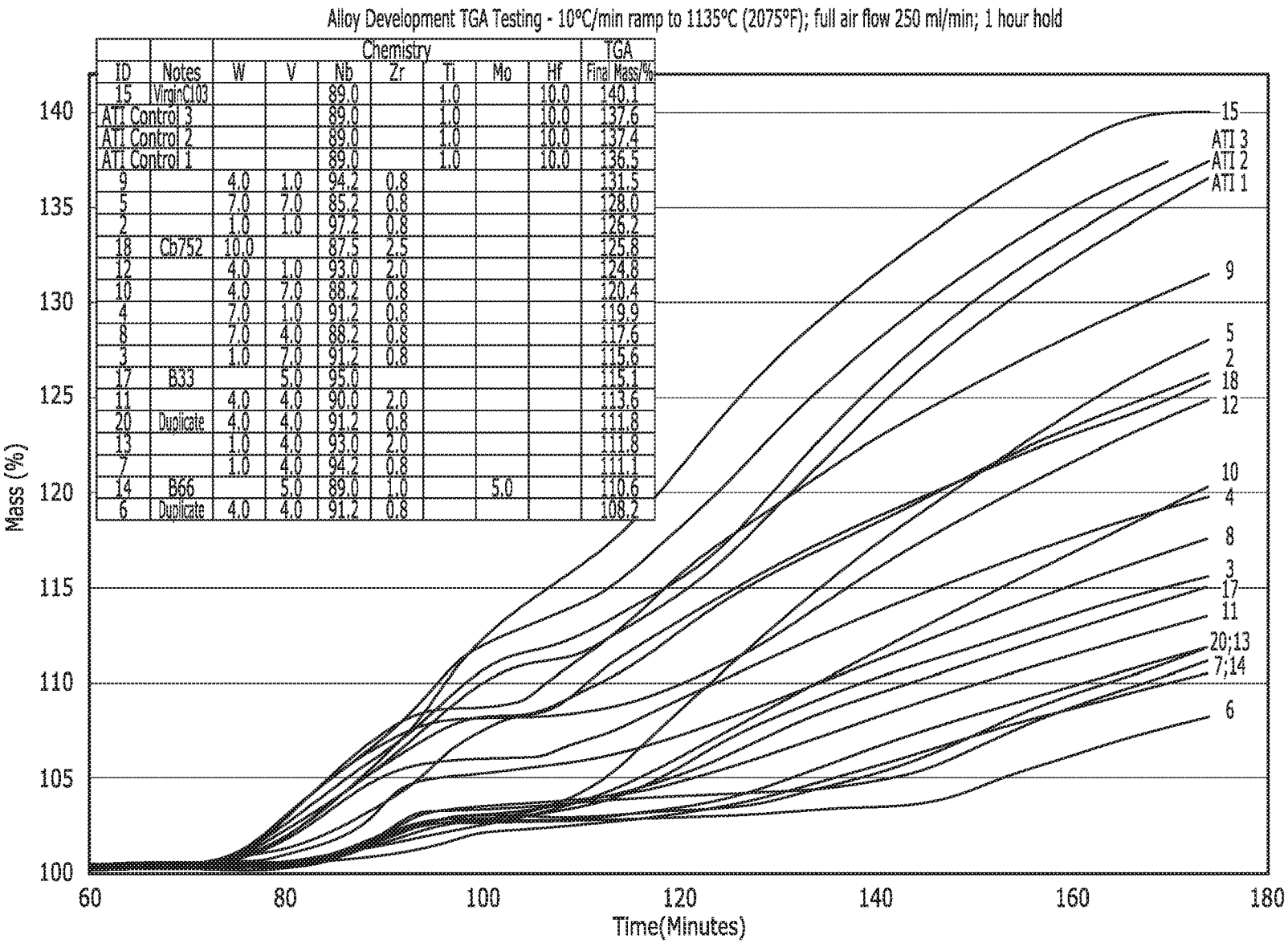
FIG. 1 is a graphical representation of thermogravimetric analysis (TGA) data of alloy sheets with testing at 10° C./min ramp to 1135° C. (2075 F) with full air flow of 250 ml/min and a 1 hour hold.

The detailed description set forth below in connection with the appended drawings, in which like numerals reference like elements, is intended as a description of various embodiments of the disclosed subject matter and is not intended to represent the only embodiments. Each embodiment described in this disclosure is provided merely as an example or illustration and is not to be construed as preferred or advantageous over other embodiments. The illustrative examples provided herein are not intended to be exhaustive or to limit the claimed subject matter to the precise forms disclosed.

In the following description, numerous specific details are set forth to provide a thorough understanding of one or more embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. In addition, it will be appreciated that embodiments of the present disclosure may employ any combination of features described herein. Further, the process steps disclosed herein may be carried out serially or in parallel where applicable, or can be carried out in a different order.

Reference quantities, percentages, and other similar references in the present disclosure, are only to assist in helping describe and understand the particular embodiment. Unless specifically stated, such quantities and numbers are not to be considered restrictive, but representative of the possible quantities or numbers associated with the present disclosure. In the embodiments described herein, "about," "approximately," etc., means plus or minus 5% of the stated value.

Embodiments of the present disclosure are directed to niobium alloy compositions developed to replace C-103 alloy (89% Nb, 10% Hf and 1% Ti, also written as Nb-10Hf-1Ti). In one embodiment of the present disclosure, a niobium alloy composition includes a niobium content as the balance of an alloy with the following constituents; a vanadium content in the range of about 2 to about 12 weight percent, a hafnium content in the range of about 5 to about 13 weight percent, and a titanium and/or zirconium content in the range of about 0.25 to about 2.5 weight percent.

In another embodiment of the present disclosure, a niobium alloy composition consists of a niobium content as the balance of an alloy with the following alloying constituents; a vanadium content in the range of about 2 to about 12 weight percent, a hafnium content in the range of about 5 to about 13 weight percent, and a titanium and/or zirconium content in the range of about 0.25 to about 2.5 weight percent.

In one embodiment of the present disclosure, the niobium alloy composition has a lower final mass/% compared to C-103 alloy when comparing thermogravimetric analysis results performed at elevated temperature with full air flow. The difference in thermogravimetric analysis results compared to C-103 alloys represents improved oxidation resistance at high temperature for the alloy.

In another embodiment of the present disclosure, the niobium content may be in the range of about 70 to about 90 weight percent. In another embodiment of the present disclosure, the niobium content may be in the range of about 77 to about 85 weight percent.

In another embodiment of the present disclosure, the vanadium content may be in the range of about 2 to about 12 weight percent. In another embodiment of the present disclosure, the vanadium content may be in the range of about 5 to about 12 weight percent. In another embodiment of the present disclosure, the vanadium content may be in the range of about greater-than-5 to about 12 weight percent. In another embodiment of the present disclosure, the vanadium content may be in the range of greater-than-5 to about 9 weight percent.

In another embodiment of the present disclosure, the hafnium content is in the range of greater-than-5 to about 13 weight percent. In another embodiment of the present disclosure, the hafnium content is in the range of about 8 to about 13 weight percent.

In another embodiment of the present disclosure, the titanium and/or zirconium content is in the range of about 0.25 to about 2.5 weight percent. In another embodiment of the present disclosure, the titanium and/or zirconium content is in the range of about 0.5 to about 2.0 weight percent. In another embodiment of the present disclosure, the titanium and/or zirconium content is in the range of about 0.7 to about 1.5 weight percent.

In other embodiments of the present disclosure, the niobium metal alloy composition may include other alloying metals, including but not limited to tungsten, molybdenum, tantalum, rhenium, and combinations thereof.

Primary characteristics of at least some of the embodiments of niobium alloy of the present application include one or more of the following. First, some niobium alloys in accordance with embodiments of the present disclosure demonstrate a 50% or more increase in specific yield strength at elevated temperature, which may, for example, be greater than or equal to 2000° F. (a non-limiting example may be 2400° F.) in an oxygen limited environment compared to previously developed C-103 niobium alloy. An oxygen limited environment may be an inert or partial vacuum environment with an oxygen level of less than about 100 ppm. Some niobium alloys in accordance with embodiments of the present disclosure demonstrate an increase of 50% to up to 100% the specific yield strength of C-103 niobium alloy at a testing temperature of 2000° F. in an oxygen limited environment. Some niobium alloys in accordance with embodiments of the present disclosure demonstrate an increase of more than 100% the specific yield strength of C-103 niobium alloy at a testing temperature of 2000° F. in an oxygen limited environment. Specific yield strength is the density normalized tensile yield strength.

Second, some niobium alloys in accordance with embodiments of the present disclosure have low temperature ductility at temperatures of less than −196° C. (−321° F.). Third, some niobium alloys in accordance with embodiments of the present disclosure are capable of tungsten inert gas (TIG) welding without a significant reduction in strength, coatability, cryogenic ductility, or other material properties. TIG welding is an arc welding process using a non-consumable tungsten electrode to produce the weld.

Fourth, some niobium alloys in accordance with embodiments of the present disclosure have the ability to accept a coating for oxidation resistance without loss of material properties. Such coatings may include an aluminide diffusion coating, a silicide coating, or other suitable coatings.

Other secondary design factors of some niobium alloys in accordance with embodiments of the present disclosure include general fabricability, formability, oxidation resistance, alloying cost, stiffness (modulus) at 2400° F., and as-coated emissivity.

Because of the high molecular weight of hafnium (178.49 g/mole) compared to niobium (92.91 g/mole), vanadium (50.94 g/mole), and titanium (47.87 g/mole) and/or zirconium (91.22 g/mole) and the difficulty in sourcing hafnium, the first iteration of various alloy compositions for button melting were prepared excluding hafnium, as listed below in TABLE 1 of EXAMPLE 1. However, it was determined by the inventors that the carbide formation temperature of these alloys was substantially lower than the carbide formation temperature in C-103 niobium alloy. The carbide formation temperature in C-103 niobium alloy is believed to be elevated as a result of the high level of hafnium present in this alloy. The consideration of carbide precipitation temperature was then incorporated into the model and, in some cases, for subsequent alloy button melting, processing, and evaluation, as described in EXAMPLES 2-4 below.

Regarding the specific components of the niobium alloy, the hafnium content of the alloy provides increased weldability properties from grain pinning dispersion, high temperature strength from solution hardening, carbide formation, and oxygen gettering. As mentioned above, hafnium carbide forms at a high temperature, adding to weld properties and high temperature resistance properties to the alloy.

The vanadium content of the alloy, like hafnium, provides strength properties to the alloy from solution hardening.

Vanadium forms a continuous series of solid solutions with niobium. Vanadium is therefore effective at improving the tensile properties of niobium. Vanadium is a slightly smaller atom than niobium, and therefore, as a substitutional alloying element to niobium, causes strain from the mismatch in the crystal structure.

The titanium and/or zirconium content of the alloy serves multiple purposes including but not limited to carbide formation, nitrogen and oxygen gettering, and behaving as a strengthening agent. Zirconium can also be useful for stability of grain refining dispersion.

Alloy buttons were made in accordance with standard parameters, as described in greater detail in Example 1. The buttons were tested in accordance with the test methods described below.

Other alloying metals, including but not limited to tungsten, molybdenum, tantalum, rhenium, and combinations thereof, may provide other design features to the metal alloy. Tungsten and molybdenum can be useful for solution hardening.

Grain Size Analysis: Circular intercept procedure performed manually per ASTM E112 (Abrams three-circle procedure). Mounting and polishing were performed using standard metallographic preparation techniques following the guidelines outlined in ASTM E3.

Micro-hardness: Sheet samples were tested using Micro-Vickers hardness method in accordance with ASTM E384 standards using a 300 g load. Sheet sections were sectioned parallel to the original rolling direction. Mounting and polishing were performed using standard metallographic preparation techniques following the guidelines outlined in ASTM E3. Prior to testing, hardness measurements were verified against a stainless steel validation block, validating measurements to be within acceptable accuracy. A line of hardness indents were applied to the center of each material sheet, maintaining a minimum of 4*x* the diagonal indent size away from the sheet faces to avoid free surface effects. Each indentation was spaced a minimum of 4*x* the typical indent size apart, in accordance with ASTM E384 recommendations. A minimum of 10 indentations per sheet were applied and measured to generate a statistically relevant hardness measurement across a volume of material. More data points than this were not feasible as a result of the short length of the sheets. For each material, the average hardness and standard deviation were reported.

Bend Testing (Room temperature): Approximately 0.5" wide samples were bent 90 degrees around a 0.5" diameter mandrel. The bend radius is then inspected on both sides for any cracking or fracturing. A passing result is given if no cracking or fracturing is observed.

Bend Testing (Cryogenic temperature): Same procedure as Room Temperature, except samples are submerged in liquid nitrogen for a sufficient amount of time for them to come to thermal equilibrium. Samples are rapidly removed from the liquid nitrogen and immediately bent over the same 0.5" diameter mandrel.

Tensile Testing (Room temperature): 0.4"W×2.5"L× Gauge tensile bars were prepared in accordance with ASTM E8.

Tensile Testing (Elevated temperature): 0.5"W×6.0"L× Gauge tensile bars were tested per SPX-00023759 procedure. This procedure involves testing per ASTM E21 with additional requirements including temperature monitoring, ramp conditions, oxygen and dew point maximums, etc.

Diffusion Coating Thickness Measurement: An aluminum based diffusion coating was applied to samples by dipping samples in mixed coating solution. These were then processed to the manufacture recommended diffusion heat treatment cycle. Samples were then sectioned, mounted, and polished. Samples were analyzed in the SEM to observe coating thickness, diffusion layer thickness, and parent material. An average of at least three diffusion thickness measurements were averaged for each reported value.

EXAMPLES 1-4 below detail test results for alloy buttons without hafnium content in the niobium alloy composition (EXAMPLE 1) and with hafnium content in the niobium alloy composition (EXAMPLES 2-4).

Example 1

Test Buttons Excluding Hafnium 200 gram buttons were prepared for testing in accordance with pure material inputs as detailed in Table 1. 200 gram buttons were used as a result of unexplained differences in predicted and actual hardness values achieved with 5 gram buttons. Larger 200 gram buttons provided enough material of each investigated alloy to allow for tensile testing and welding trials.

The 200 gram button input material was weighed and prepared using pure material inputs as detailed in Table 1. Alloy input constituents were cleaned with IPA and weighed in preparation for melting targeted alloy compositions. Two virgin input control C-103 buttons (Nb-10Hf-1Ti) and three wrought input control (sheet product to be re-melted) C-103 buttons were melted for processing and property verification.

Button weights of 200 grams were chosen for the calculated dimensions of the final rolled sheets of approximately 3"W×24"L at 0.030"T. These sheets allowed for room and elevated temperature tensile testing, welding trials, coating trials, room temperature and cryogenic temperature bend testing of parent material and welds, ASTM grain size evaluation, and microhardness measurement.

Input material was melted. In an effort to minimize impurities, the equipment was thoroughly cleaned before each melt using IPA and Scotch Brite pads. Constituents were loaded into the water cooled copper crucible, placing alloy additions on the bottom and putting larger niobium input on top. After adequate cooling, the button was flipped and the process was repeated twice more to ensure each button was homogeneously melted and stirred a total of 3 times.

Buttons were ground to remove surface imperfections or any evidence of laps, seams, folds, or any other visible defect. Areas that were likely to fold over during forging to create a lap were ground in a manner to remove any likelihood of these defects being created during forging.

Buttons were then packed into low carbon steel cans to prevent oxidation during forging Canned buttons were heated in a gas fired furnace at greater than 1800° F. and for a minimum of 40 minutes. They were then forged on a large two post forge press over the course of about one second. The resulting product was a flattened can that was less than ½" thick. These cans were then cut open to remove the forged button. Buttons were inspected for defects, and any noticeable defect or area that may turn into a lap or seam during subsequent cold rolling was ground and smoothed out before anneal.

Buttons were wrapped in tantalum foil and vacuum annealed in 10ˆ-5 Torr or better at greater than 2000° F. for 1 hour time-at-temperature followed by an argon backfill at end of cycle. The forged and annealed buttons were cold rolled on a 100,000 pound rolling mill. Buttons were rolled to a nominal 0.030" thickness. Trial anneals were performed to determine a vacuum heat treat cycle resulting in the desired grain structure with an ASTM grain size between 7.0 and 9.0.

Rolled and annealed sheets were marked with locations to produce two 6"×0.5" high temperature tensile coupons, two 2.5"×0.4" room temperature tensile coupons, two bend coupons, and welding trial material. Two pieces of each alloy composition were then edge prepped and TIG welded together using parameters similar or identical to those used to TIG weld C-103 alloy. Welds were visually and dye penetrant inspected for defects before taking further samples to ensure quality welds for evaluation. The welded region was divided to give weld micrograph samples, two bend samples, and an oxidation coating sample.

Material testing was performed at room temperature and 2000° F. to evaluate ultimate and yield tensile stress, and elongation, with results provided in Table 1 and Table 2, respectively. Bend testing was performed at room temperature and cryogenic temperature, and results are outlined in Table 3. Material density was measured at room temperature, and results are provided in Table 1.

TABLE 1 room Temperature mechanical and property evaluation of Primary Melting Round rolled and annealed button material.

| Button ID | W | V | Nb | Zr | Ti | Mo | Hf | Density (lb/in ^ 3) | RT UTS (ksi) | RT YS (ksi) | RT % E | ASTMGS | RT Specific UTS (ksi/(lb/in ^ 3)) | RT Specific YS (ksi/(lb/in ^ 3)) |
|---|---|---|---|---|---|---|---|---|---|---|---|---|---|---|
| 2 | 1.0 | 1.0 | 97.2 | 0.8 | | | | 0.312 | 59.6 | 42.1 | 27.6 | 8.2 | 191.0 | 135.2 |
| 3 | 1.0 | 7.0 | 91.2 | 0.8 | | | | 0.308 | 106.0 | 75.4 | 21.7 | 8.5 | 344.2 | 244.8 |
| 4 | 7.0 | 1.0 | 91.2 | 0.8 | | | | 0.311 | 79.0 | 60.9 | 24.4 | 8.6 | 254.3 | 196.3 |
| 5 | 7.0 | 7.0 | 85.2 | 0.8 | | | | 0.308 | 109.3 | 102.5 | 11.9 | 8.1 | 354.5 | 332.4 |
| 6 | 4.0 | 4.0 | 91.2 | 0.8 | | | | 0.316 | 95.3 | 70.5 | 25.1 | 8.3 | 302.1 | 223.2 |
| 7 | 1.0 | 4.0 | 94.2 | 0.8 | | | | 0.309 | 82.6 | 62.4 | 16.0 | 8.4 | 267.5 | 202.1 |
| 8 | 7.0 | 4.0 | 88.2 | 0.8 | | | | 0.319 | 98.7 | 80.7 | 14.7 | 8.0 | 309.4 | 252.9 |
| 9 | 4.0 | 1.0 | 94.2 | 0.8 | | | | 0.318 | 68.8 | 50.6 | 24.1 | 7.5 | 216.3 | 159.1 |
| 10 | 4.0 | 7.0 | 88.2 | 0.8 | | | | 0.317 | 115.9 | 93.9 | 18.6 | 8.5 | 365.4 | 296.0 |
| 11 | 4.0 | 4.0 | 90.0 | 2.0 | | | | 0.311 | 95.5 | 74.7 | 20.6 | 7.7 | 307.1 | 240.5 |
| 12 | 4.0 | 1.0 | 93.0 | 2.0 | | | | 0.322 | 73.8 | 53.1 | 21.6 | 7.8 | 229.4 | 165.1 |
| 13 | 1.0 | 4.0 | 93.0 | 2.0 | | | | 0.304 | 86.7 | 66.6 | 20.7 | 6.9 | 285.5 | 219.2 |
| 14 | | 5.0 | 89.0 | 1.0 | | 5.0 | | 0.301 | 119.8 | 97.2 | 18.5 | 8.2 | 398.3 | 323.0 |
| 15 | | | 89.0 | | 1.0 | | 10.0 | 0.327 | 59.9 | 45.9 | 18.4 | 8.1 | 183.4 | 140.4 |
| 17 | | 5.0 | 95.0 | | | | | 0.313 | 86.0 | 66.2 | 20.2 | 7.1 | 274.5 | 211.3 |
| 18 | 10.0 | | 87.5 | 2.5 | | | | 0.329 | 86.1 | 69.1 | 22.5 | 8.4 | 261.7 | 210.3 |
| 20 | 4.0 | 4.0 | 91.2 | 0.8 | | | | 0.318 | 101.1 | 84.7 | 22.7 | 8.4 | 317.9 | 266.3 |
| C2 | | | 89.0 | | 1.0 | | 10.0 | 0.320 | 61.2 | 47.2 | 22.7 | 7.0 | 191.1 | 147.5 |
| C3 | | | 89.0 | | 1.0 | | 10.0 | 0.320 | 64.2 | 49.0 | 28.5 | 6.9 | 200.6 | 153.0 |
| ATI1 | | | 89.0 | | 1.0 | | 10.0 | 0.325 | 66.7 | 49.4 | 32.3 | | 205.4 | 152.3 |
| ATI2 | | | 89.0 | | 1.0 | | 10.0 | 0.325 | 66.5 | 50.2 | 32.9 | | 205.0 | 154.7 |
| ATI3 | | | 89.0 | | 1.0 | | 10.0 | 0.325 | 65.0 | 49.0 | 31.7 | | 200.3 | 150.9 |

TABLE 2

2000° F. mechanical evaluation of Primary Melting Round rolled and annealed button material.

| Button ID | W | V | Nb | Zr | Ti | Mo | Hf | 2000° F. UTS (ksi) | 2000° F. YS (ksi) | 2000° F. % E | 2000° F. Modulus (Mpsi) | 2000° F. Specific UTS (ksi/(lb/in ^ 3)) | 2000° F. Specific UTS (ksi/(lb/in ^ 3)) |
|---|---|---|---|---|---|---|---|---|---|---|---|---|---|
| 2 | 1.0 | 1.0 | 97.2 | 0.8 | | | | 25.7 | 36.4 | 12.2 | 13.8 | 82.3 | 116.7 |
| 3 | 1.0 | 7.0 | 91.2 | 0.8 | | | | 46.9 | 54.3 | 20.2 | 15.3 | 152.3 | 176.2 |
| 4 | 7.0 | 1.0 | 91.2 | 0.8 | | | | 28.5 | 40.9 | 16.0 | 15.8 | 91.9 | 131.7 |
| 5 | 7.0 | 7.0 | 85.2 | 0.8 | | | | 52.0 | 59.4 | 12.7 | 15.0 | 168.8 | 192.6 |
| 6 | 4.0 | 4.0 | 91.2 | 0.8 | | | | 38.8 | 47.1 | 18.4 | 15.4 | 123.1 | 149.2 |
| 7 | 1.0 | 4.0 | 94.2 | 0.8 | | | | 35.5 | 42.7 | 22.4 | 16.3 | 115.1 | 138.4 |
| 8 | 7.0 | 4.0 | 88.2 | 0.8 | | | | 42.6 | 51.9 | 16.9 | 15.1 | 133.6 | 162.8 |
| 9 | 4.0 | 1.0 | 94.2 | 0.8 | | | | 26.7 | 36.9 | 15.8 | 16.0 | 83.8 | 116.0 |
| 10 | 4.0 | 7.0 | 88.2 | 0.8 | | | | 48.7 | 55.4 | 12.8 | 15.2 | 153.5 | 174.8 |
| 11 | 4.0 | 4.0 | 90.0 | 2.0 | | | | 40.7 | 50.1 | 13.7 | 15.0 | 130.9 | 161.2 |
| 12 | 4.0 | 1.0 | 93.0 | 2.0 | | | | 31.2 | 42.1 | 8.7 | 15.6 | 96.9 | 130.8 |
| 13 | 1.0 | 4.0 | 93.0 | 2.0 | | | | 37.2 | 47.0 | 14.3 | 14.6 | 122.5 | 154.7 |
| 15 | | | 89.0 | | 1.0 | | 10.0 | 24.9 | 33.7 | 17.0 | 11.2 | 76.3 | 103.2 |
| 17 | | 5.0 | 95.0 | | | | | 37.7 | 40.2 | 32.5 | 16.6 | 120.5 | 128.2 |
| 18 | 10.0 | | 87.5 | 2.5 | | | | 27.2 | 39.4 | 6.4 | 24.5 | 82.7 | 119.8 |
| 20 | 4.0 | 4.0 | 91.2 | 0.8 | | | | 39.8 | 47.9 | 17.2 | 15.7 | 125.1 | 150.5 |

TABLE 3

Bend testing of Primary Melting Round alloys in various combinations of bend test temperature, welding, and coating

| Button ID | W | V | Nb | Zr | Ti | Mo | Hf | Cryogenic Welded Bend | Cryogenic Coated Bend | Cryogenic Welded & Coated Bend | RT Coated Bend | RT Welded & Coated Bend | Coating Diffusion Thickness (microns) |
|---|---|---|---|---|---|---|---|---|---|---|---|---|---|
| 2 | 1.0 | 1.0 | 97.2 | 0.8 | | | | Crack | Pass | Fail | Pass | Pass | 0.00 |
| 3 | 1.0 | 7.0 | 91.2 | 0.8 | | | | Fail | Pass | Fail | Pass | Pass | 2.35 |
| 4 | 7.0 | 1.0 | 91.2 | 0.8 | | | | Fail | Pass | Fail | Pass | Pass | 3.30 |
| 5 | 7.0 | 7.0 | 85.2 | 0.8 | | | | — | Fail | — | Pass | — | 5.03 |
| 6 | 4.0 | 4.0 | 91.2 | 0.8 | | | | Pass | Pass | Fail | Pass | Pass | 2.53 |
| 7 | 1.0 | 4.0 | 94.2 | 0.8 | | | | Fail | Pass | Fail | Pass | Pass | 2.86 |
| 8 | 7.0 | 4.0 | 88.2 | 0.8 | | | | Fail | Pass | Fail | Pass | Fail | 3.89 |
| 9 | 4.0 | 1.0 | 94.2 | 0.8 | | | | Pass | Pass | Crack | Pass | Pass | 2.54 |
| 10 | 4.0 | 7.0 | 88.2 | 0.8 | | | | Fail | Pass | Fail | Pass | Fail | 3.80 |
| 11 | 4.0 | 4.0 | 90.0 | 2.0 | | | | Fail | Pass | Fail | Pass | Fail | 2.90 |
| 12 | 4.0 | 1.0 | 93.0 | 2.0 | | | | Pass | Pass | Fail | Pass | Crack | 2.10 |
| 13 | 1.0 | 4.0 | 93.0 | 2.0 | | | | Fail | Pass | Fail | Pass | Pass | 2.43 |
| 14 | | 5.0 | 89.0 | 1.0 | | 5.0 | | — | Fail | — | Pass | — | 5.14 |
| 15 | | | 89.0 | | 1.0 | | 10.0 | Pass | Pass | Pass | — | — | 2.40 |
| 17 | | 5.0 | 95.0 | | | | | Pass | Pass | Fail | Pass | Pass | 1.80 |
| 18 | 10.0 | | 87.5 | 2.5 | | | | Fail | Pass | Fail | Pass | Fail | 2.30 |
| 20 | 4.0 | 4.0 | 91.2 | 0.8 | | | | Fail | Pass | Fail | Pass | Fail | 2.67 |
| C-103 Control | | | 89.0 | | 1.0 | | 10.0 | Fail | Pass | Pass | — | — | 2.38 |
| C-103 Control | | | 89.0 | | 1.0 | | 10.0 | Pass | Pass | Pass | — | — | 2.33 |

FIG. 1 provides thermogravimetric analysis (TGA) of the alloy sheets with testing at 10° C./min ramp to 1135° C. (2075 F) with full air flow of 250 ml/min and a 1 hour hold.

Upon completion of cryogenic bend testing of welded samples, it became apparent the alloys listed in Table 1 were not performing as anticipated as a result of fracturing of the welds and heat affected zones. SEM fractography revealed all fracture surfaces suffered brittle fracture and appeared to have a very large grain size in the weld heat affected zone. Cross sections taken from weld regions for grain size structure analysis showed excessive grain growth in all alloys except C-103.

Example 2

Test Buttons Including Hafnium 250 gram buttons were prepared for testing in accordance with pure material inputs as detailed in Table 4. All alloys investigated in this iteration had a lower final mass/% compared to C-103 alloy.

Material was subjected to similar room temperature, elevated temperature (2000° F.), bend testing, and thermogravimetric analysis with results outlined in Tables 4, 5, and 6, below, respectively. Only welded samples failed bend testing.

TABLE 4 room Temperature mechanical and property evaluation of Final Melting Round rolled and annealed button material.

| Button ID | Nb | Hf | V | W | Zr | Ti | Mo | Density (lb/in ^ 3) | RT UTS (ksi) | RT YS (ksi) | RT % E | ASTMGS | RT Specific UTS (ksi/(lb/in ^ 3)) | RT Specific YS (ksi/(lb/in ^ 3)) |
|---|---|---|---|---|---|---|---|---|---|---|---|---|---|---|
| 1 | 86.7 | 5.6 | 1.9 | 2.9 | 2.9 | | | 0.325 | 83.1 | 67.9 | 22.9 | 8.8 | 255.2 | 208.7 |
| 2 | 85.6 | 9.3 | 2.3 | 2.3 | 0.5 | | | 0.322 | 80.0 | 64.7 | 16.5 | 8.9 | 248.1 | 200.6 |
| 3 | 83.3 | 9.1 | 1.0 | 3.8 | 2.8 | | | 0.325 | 89.0 | 74.9 | 16.5 | 9.5 | 273.7 | 230.3 |
| 4 | 83.5 | 10.0 | 1.7 | 3.8 | | 1.0 | | 0.324 | 84.7 | 68.9 | 22.2 | 8.9 | 261.2 | 212.4 |
| 5 | 86.2 | 9.5 | 3.8 | | 0.5 | | 1.0 | 0.317 | 90.3 | 72.8 | 19.7 | 8.9 | 284.9 | 229.5 |
| 6 | 84.4 | 9.6 | 5.5 | | 0.5 | | 0.5 | 0.315 | 94.6 | 77.3 | 19.1 | 8.4 | 300.1 | 245.1 |
| 7 | 85.0 | 10.3 | 3.7 | | | 1.0 | | 0.314 | 81.9 | 66.0 | 26.4 | 8.1 | 260.8 | 210.3 |
| 8 | 81.3 | 10.6 | 7.0 | | | 1.1 | | 0.310 | 102.8 | 85.4 | 24.1 | 8.1 | 331.6 | 275.4 |
| 9 | 87.4 | 9.4 | 2.7 | | 0.5 | | | 0.316 | 78.0 | 61.5 | 22.9 | 8.3 | 246.4 | 194.4 |
| 10 | 84.4 | 9.6 | 5.5 | | 0.5 | | | 0.314 | 99.3 | 80.8 | 21.5 | 7.6 | 316.2 | 257.3 |
| 11 | 83.3 | 9.4 | 4.5 | 2.3 | 0.5 | | | 0.319 | 94.9 | 78.4 | 19.5 | 8.6 | 296.9 | 245.3 |
| 12 | 81.3 | 10.6 | 7.0 | | | 1.1 | | 0.308 | 111.4 | 92.4 | 18.7 | 8.4 | 361.3 | 299.7 |
| 13 | 81.3 | 10.6 | 7.0 | | | 1.1 | | 0.310 | 95.0 | 77.9 | 17.6 | 8.3 | 306.5 | 251.3 |

TABLE 4-continued room Temperature mechanical and property evaluation of Final Melting Round rolled and annealed button material.

| Button ID | Nb | Hf | V | W | Zr | Ti | Mo | Density (lb/in ^ 3) | RT UTS (ksi) | RT YS (ksi) | RT % E | ASTMGS | RT Specific UTS (ksi/(lb/in ^ 3)) | RT Specific YS (ksi/(lb/in ^ 3)) |
|---|---|---|---|---|---|---|---|---|---|---|---|---|---|---|
| 14 | 89.0 | 10.0 | | | | 1.0 | | 0.319 | 53.5 | 39.0 | 25.1 | 8.8 | 167.8 | 122.2 |
| 15 | 89.0 | 10.0 | | | | 1.0 | | 0.318 | 54.7 | 38.7 | 29.8 | 8.1 | 171.6 | 121.5 |

TABLE 5

2000° F. mechanical evaluation of Final Melting Round rolled and annealed button material.

| Button ID | Nb | Hf | V | W | Zr | Ti | Mo | 2000° F. UTS (ksi) | 2000° F. YS (ksi) | 2000° F. % E | 2000° F. Modulus (Mpsi) | 2000° F. Specific UTS (ksi/(lb/in ^ 3)) | 2000° F. Specific YS (ksi/(lb/in ^ 3)) |
|---|---|---|---|---|---|---|---|---|---|---|---|---|---|
| 1 | 86.7 | 5.6 | 1.9 | 2.9 | 2.9 | | | 38.4 | 31.8 | 27.6 | 11.8 | 117.9 | 97.7 |
| 2 | 85.6 | 9.3 | 2.3 | 2.3 | 0.5 | | | 41.2 | 32.4 | 26.7 | 11.7 | 127.8 | 100.5 |
| 3 | 83.3 | 9.1 | 1.0 | 3.8 | 2.8 | | | 39.7 | 32.9 | 33.3 | 11.3 | 121.9 | 101.3 |
| 4 | 83.5 | 10.0 | 1.7 | 3.8 | | 1.0 | | 37.5 | 30.1 | 25.6 | 12.3 | 115.8 | 92.9 |
| 5 | 86.2 | 9.5 | 3.8 | | 0.5 | | 1.0 | 43.9 | 35.6 | 27.5 | 11.8 | 138.6 | 112.4 |
| 6 | 84.4 | 9.6 | 5.5 | | 0.5 | | 0.5 | 45.7 | 38.9 | 31.3 | 10.2 | 145.0 | 123.3 |
| 7 | 85.0 | 10.3 | 3.7 | | | 1.0 | | 38.8 | 32.4 | 35.7 | 12.5 | 123.6 | 103.2 |
| 8 | 81.3 | 10.6 | 7.0 | | | 1.1 | | 47.3 | 40.9 | 29.7 | 10.5 | 152.6 | 132.0 |
| 9 | 87.4 | 9.4 | 2.7 | | 0.5 | | | 38.7 | 30.8 | 25.1 | 13.4 | 122.4 | 97.3 |
| 10 | 84.4 | 9.6 | 5.5 | | 0.5 | | | 47.6 | 40.3 | 26.2 | 11.5 | 151.5 | 128.4 |
| 11 | 83.3 | 9.4 | 4.5 | 2.3 | 0.5 | | | 47.4 | 39.4 | 27.1 | 12.3 | 148.4 | 123.4 |
| 15 | 89.0 | 10.0 | | | | 1.0 | | 27.6 | 18.9 | 13.3 | 8.9 | 86.6 | 59.2 |

TABLE 6

Bend testing of Final Melting Round alloy in various combinations of bend test temperature, welding, and coating.

| Button ID | Nb | Hf | V | W | Zr | Ti | Mo | Cryogenic Welded Bend | Cryogenic Coated Bend | Cryogenic Welded & Coated Bend | RT Coated Bend | RT Welded & Coated Bend | Coating Diffusion Thickness (microns) |
|---|---|---|---|---|---|---|---|---|---|---|---|---|---|
| 1 | 86.7 | 5.6 | 1.9 | 2.9 | 2.9 | | | Fail | Pass | Fail | Pass | Crack | 1.23 |
| 2 | 85.6 | 9.3 | 2.3 | 2.3 | 0.5 | | | Fail | Pass | Fail | Pass | Pass | 1.53 |
| 3 | 83.3 | 9.1 | 1.0 | 3.8 | 2.8 | | | Fail | Pass | Fail | Pass | Fail | 1.47 |
| 4 | 83.5 | 10.0 | 1.7 | 3.8 | | 1.0 | | Crack | Pass | Fail | Pass | Fail | 1.05 |
| 5 | 86.2 | 9.5 | 3.8 | | 0.5 | | 1.0 | Crack | Pass | Fail | Pass | Crack | 1.99 |
| 6 | 84.4 | 9.6 | 5.5 | | 0.5 | | 0.5 | Fail | Pass | Fail | Pass | Crack | 3.11 |
| 7 | 85.0 | 10.3 | 3.7 | | | 1.0 | | Crack | Pass | Fail | Pass | Pass | 3.06 |
| 8 | 81.3 | 10.6 | 7.0 | | | 1.1 | | Pass | Pass | Crack | Pass | — | 2.82 |
| 9 | 87.4 | 9.4 | 2.7 | | 0.5 | | | Crack | Pass | Fail | Pass | Pass | 0.94 |
| 11 | 83.3 | 9.4 | 4.5 | 2.3 | 0.5 | | | Crack | Pass | Fail | Pass | Fail | 1.94 |
| 12 | 81.3 | 10.6 | 7.0 | | | 1.1 | | Crack | Pass | Fail | Pass | Fail | 2.81 |
| 13 | 81.3 | 10.6 | 7.0 | | | 1.1 | | Crack | Pass | Crack | Pass | Fail | 3.32 |
| 14 | 89.0 | 10.0 | | | | 1.0 | | Pass | Pass | Pass | Pass | Pass | 1.35 |
| 15 | 89.0 | 10.0 | | | | 1.0 | | Pass | Pass | Pass | Pass | Pass | 1.60 |

Figure 2:
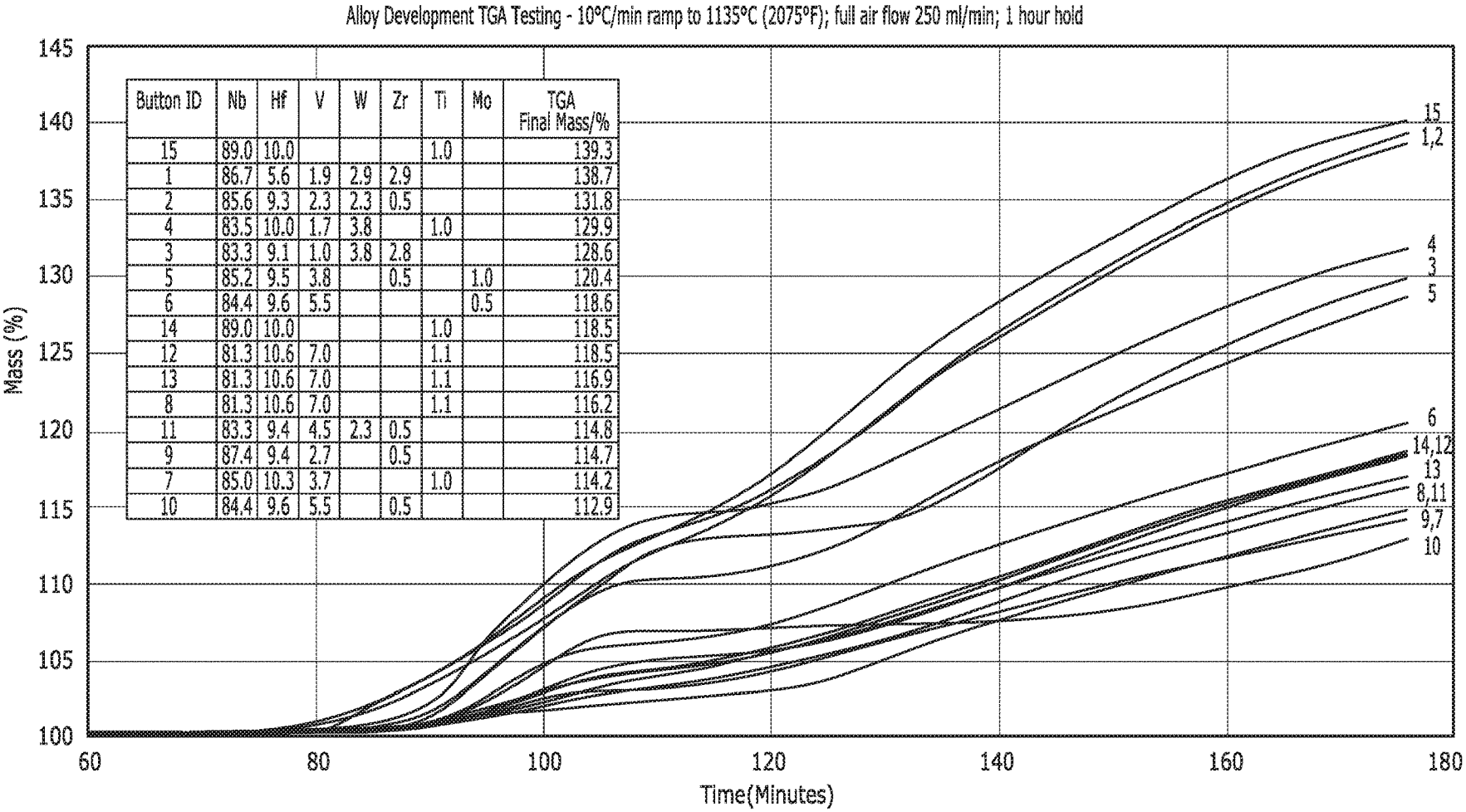
FIG. 2 is a graphical representation of thermogravimetric analysis (TGA) data of alloy sheets with testing at 10° C./min ramp to 1135° C. (2075 F) with full air flow of 250 ml/min and a 1 hour hold.
Figure 3:
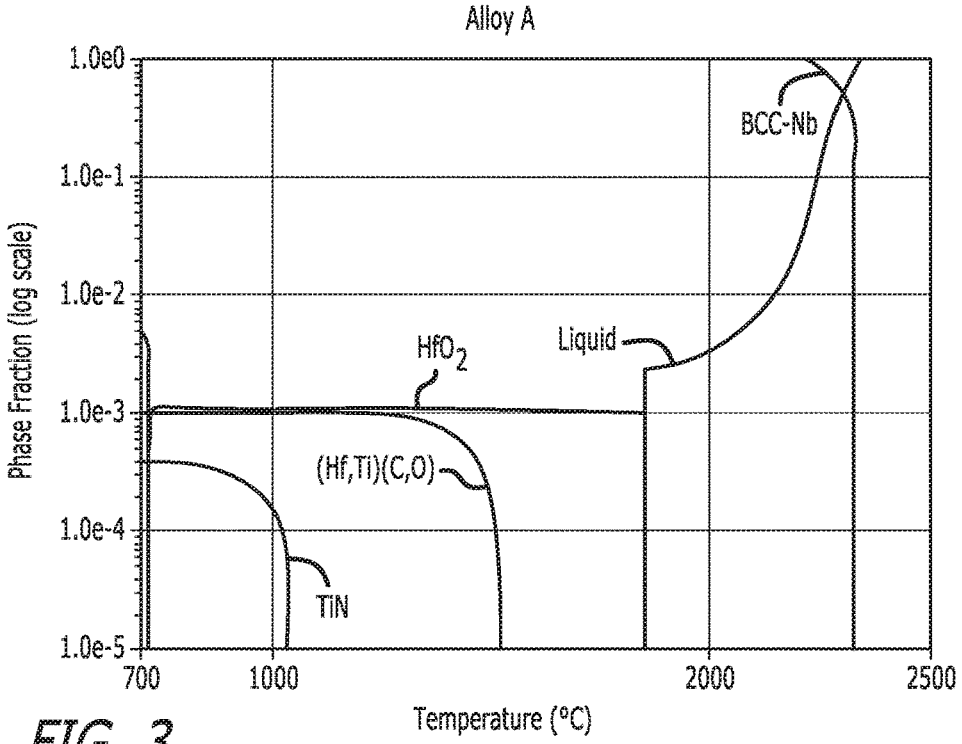
FIGS. 3-7 are graphical representations of calculated step diagrams for each of the compositions A-E listed above in Table 10 (all with typical interstitial levels of 50 ppm C, 25 ppm N, and 120 ppm O), showing the major phases that form and their phase fractions as a function of temperature.
Figure 4:
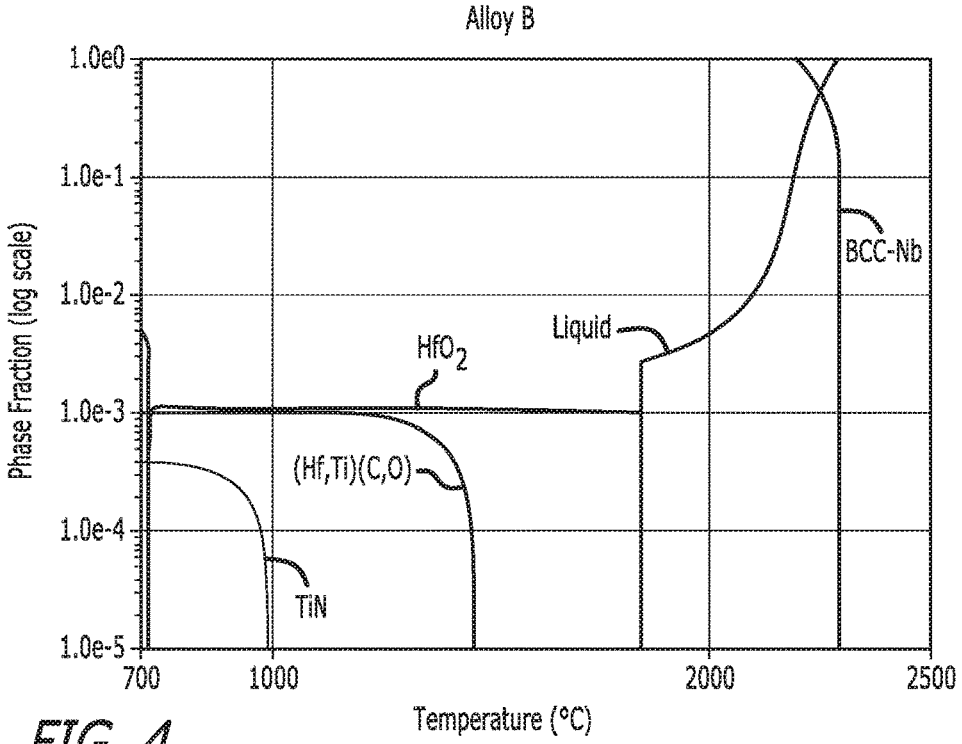
Figure 5:
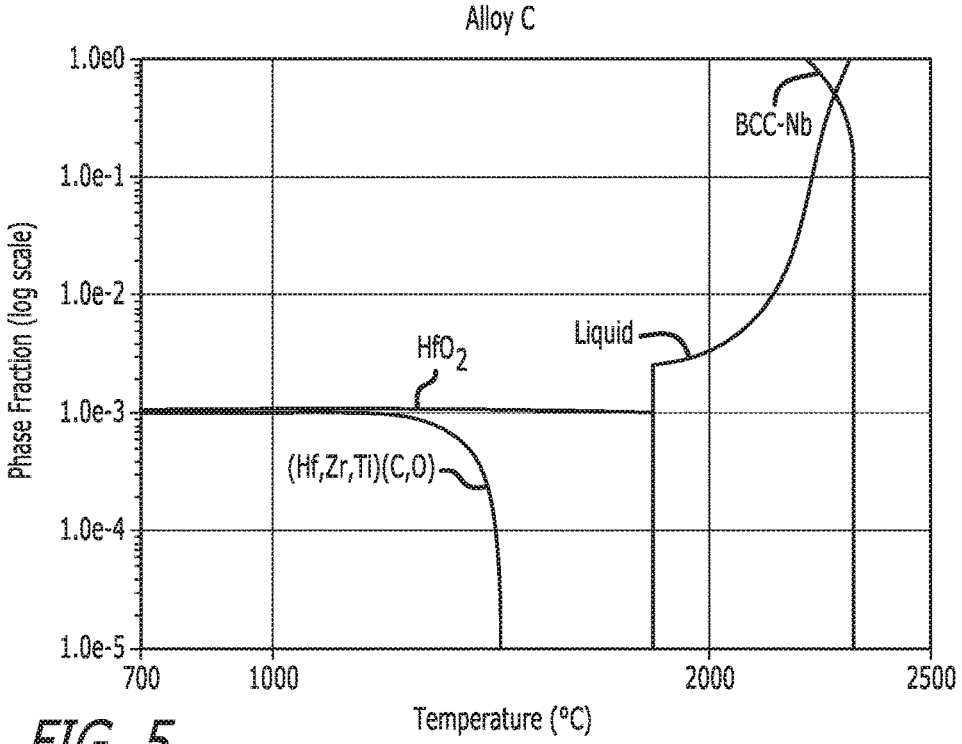
Figure 6:
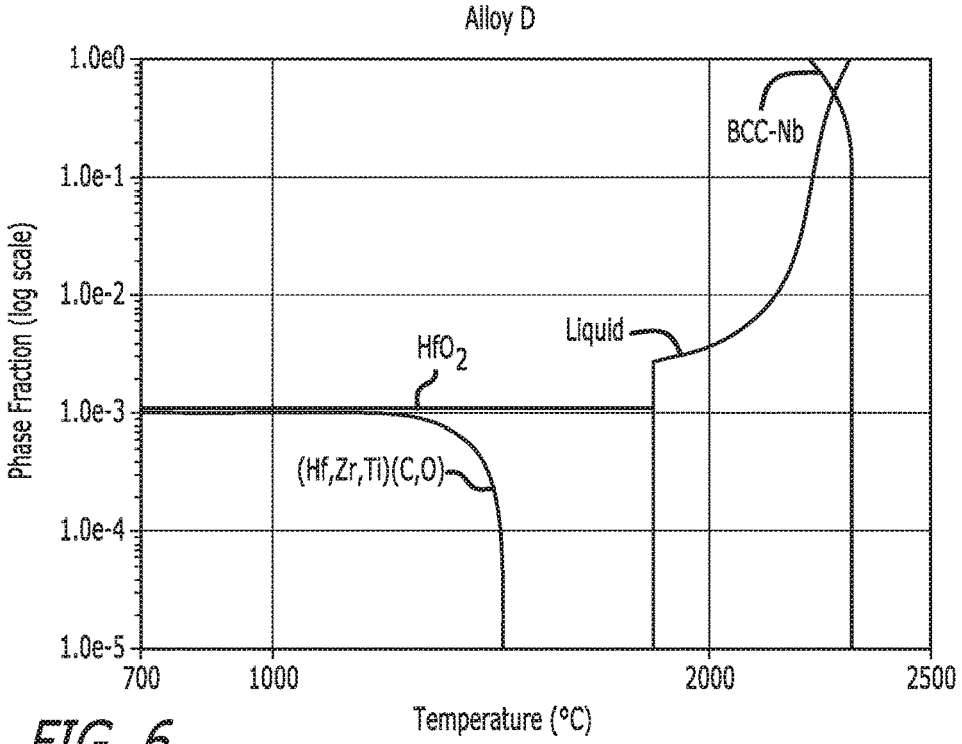
Figure 7:
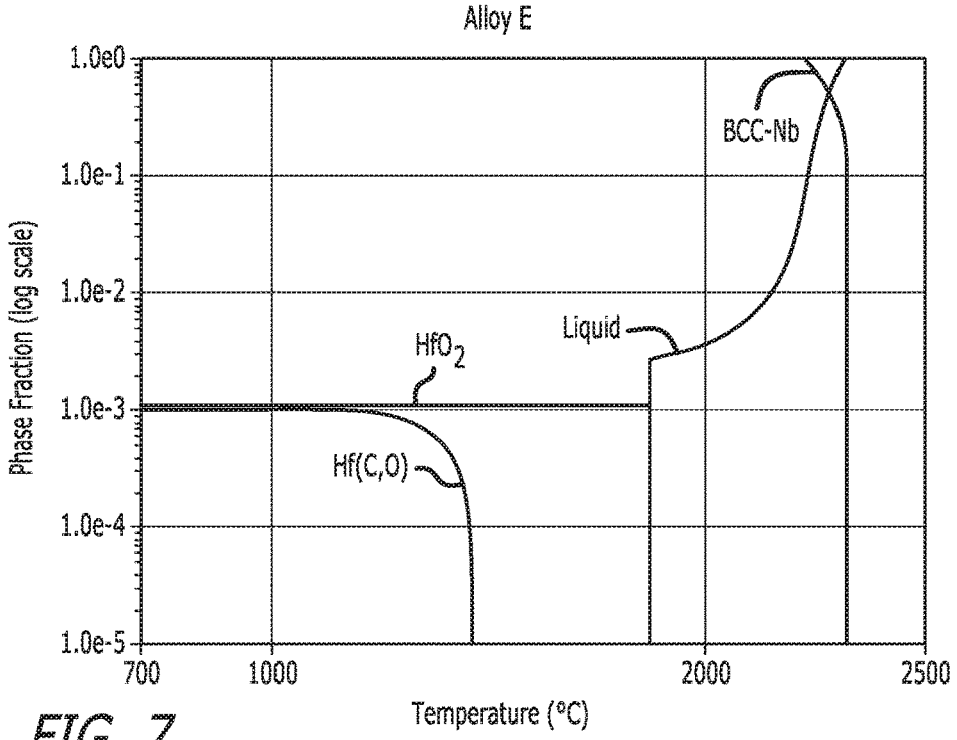
Figure 8:
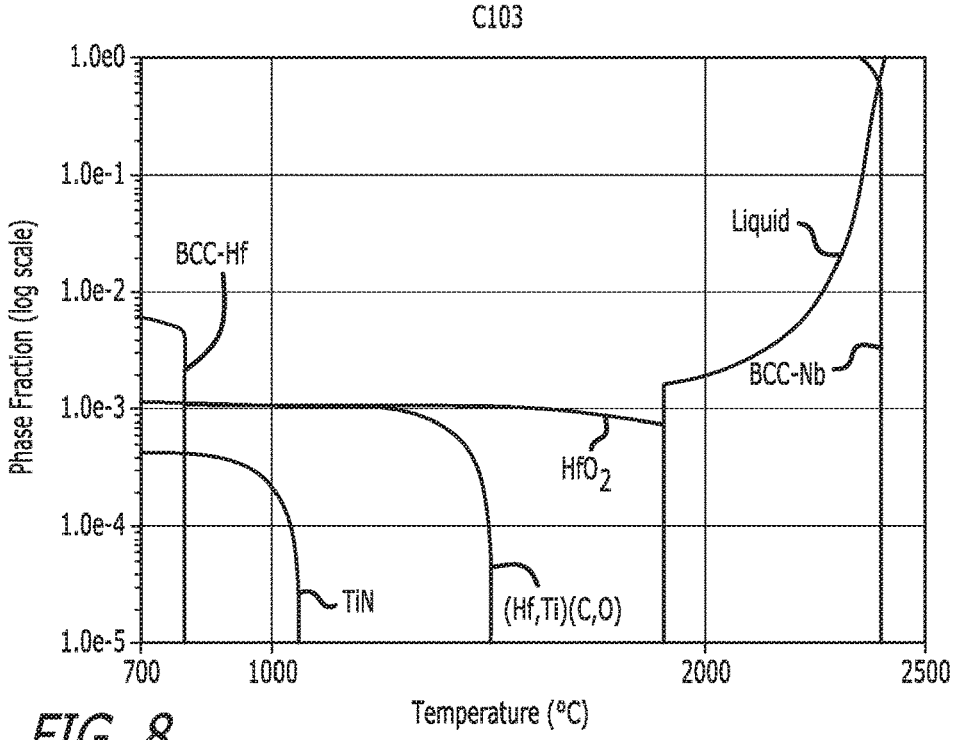
FIG. 8 is a graphical representation of a calculated step diagram for baseline C-103, showing the stables phases and their fractions as a function of temperature.
Figure 9:
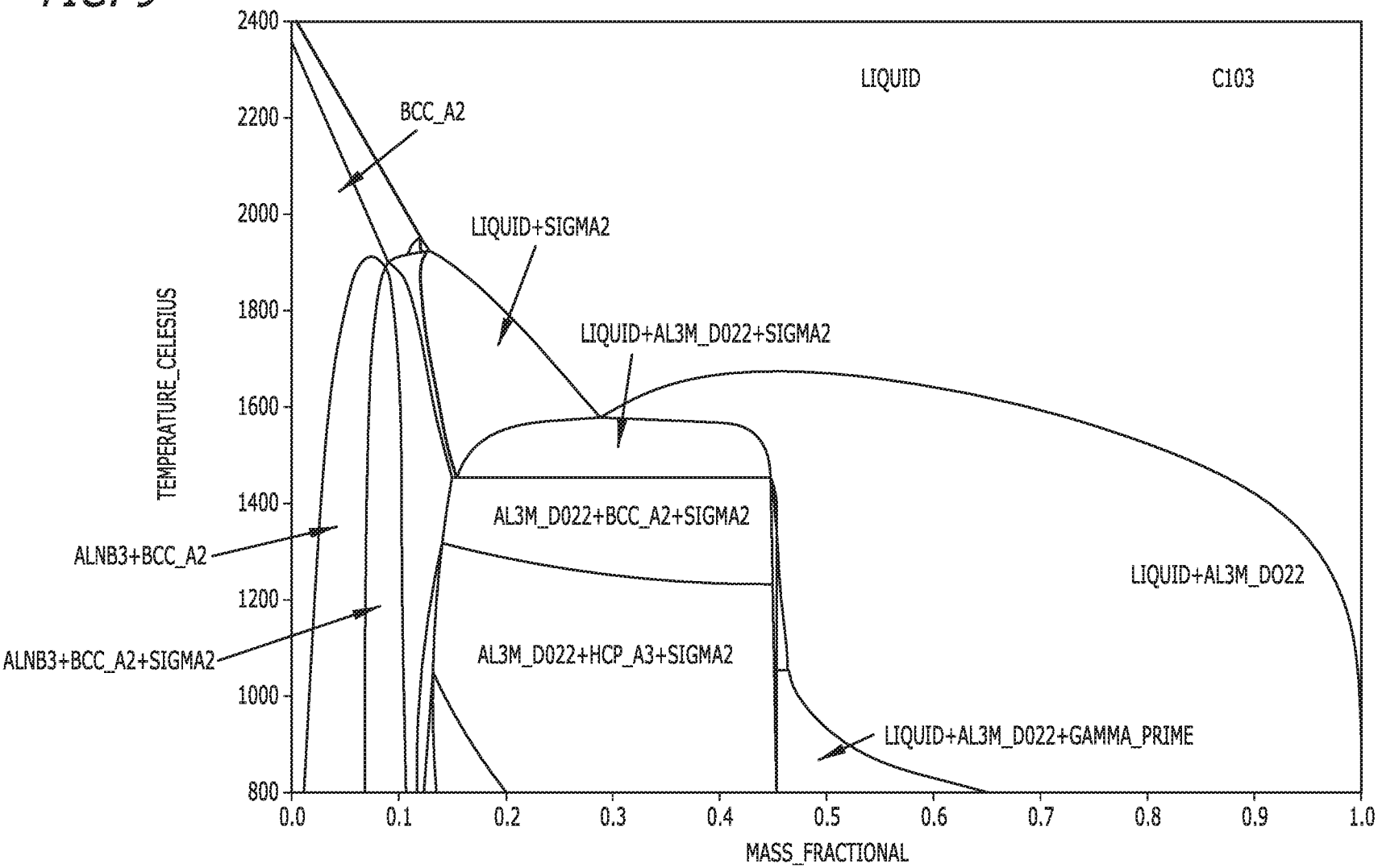
FIGS. 9-14 are graphical representations of pseudo-binary phase diagrams showing the phase stability as a function of aluminum content for each alloy concept in Table 10 and baseline C-103.
Figure 10:
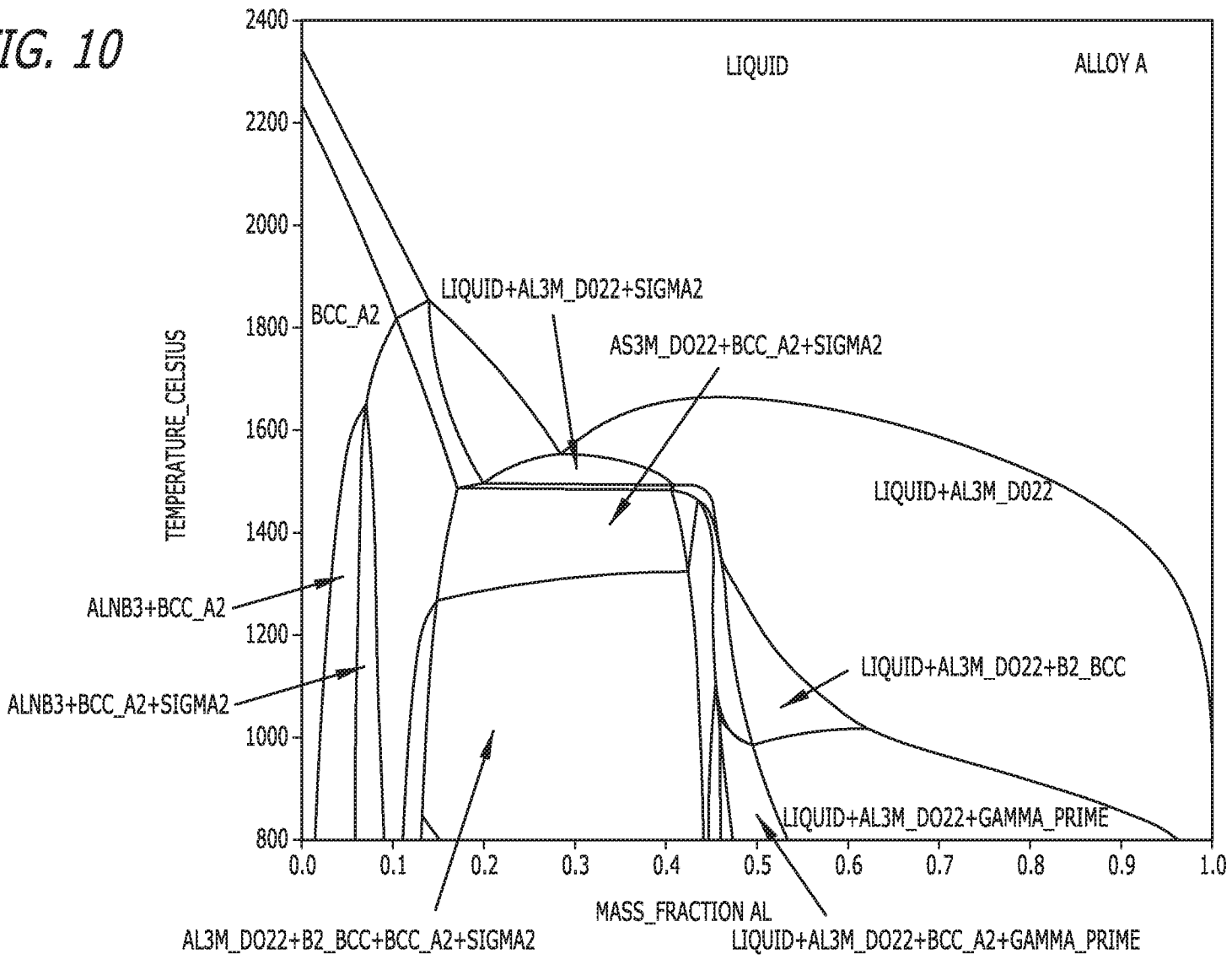
Figure 11:
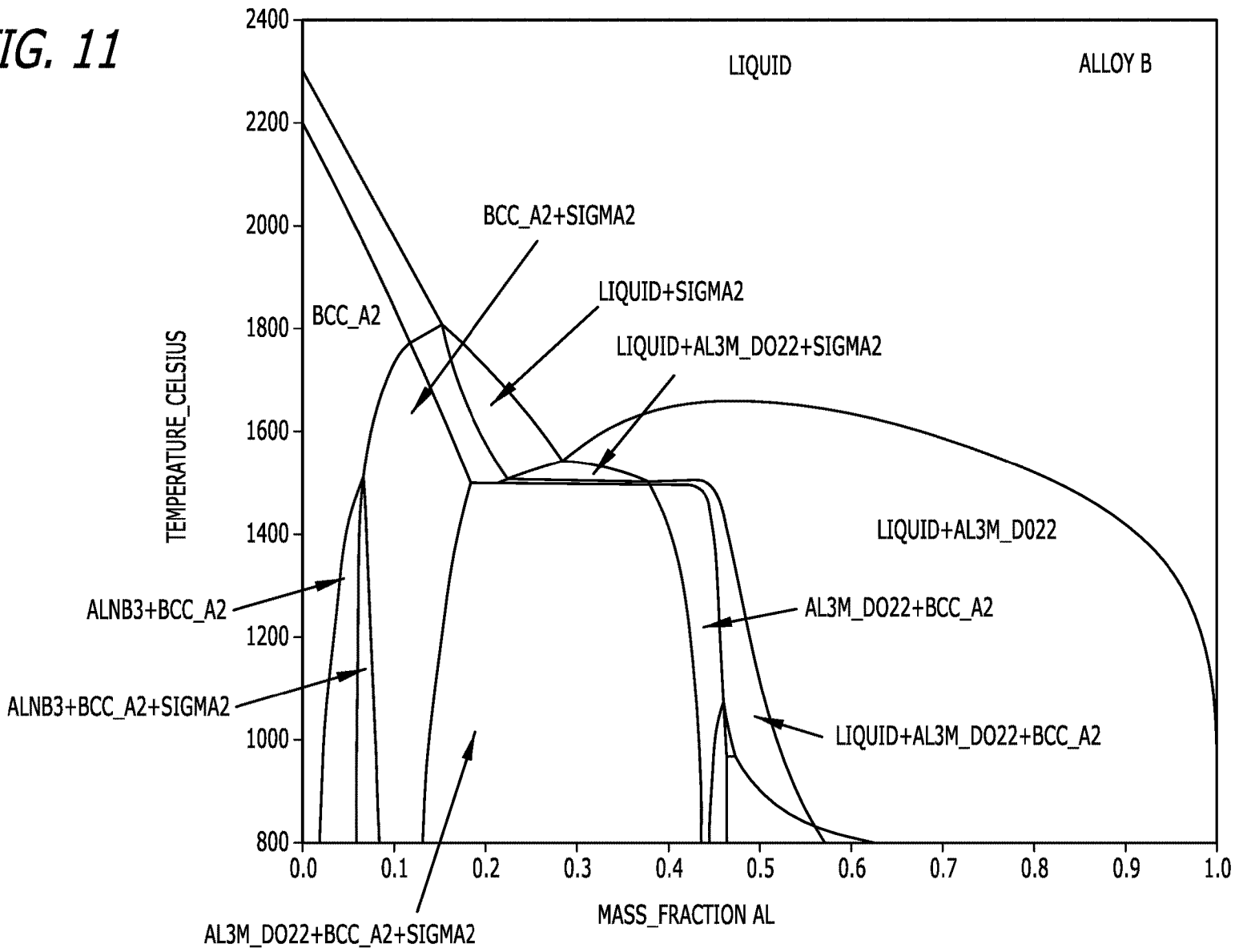
Figure 12:
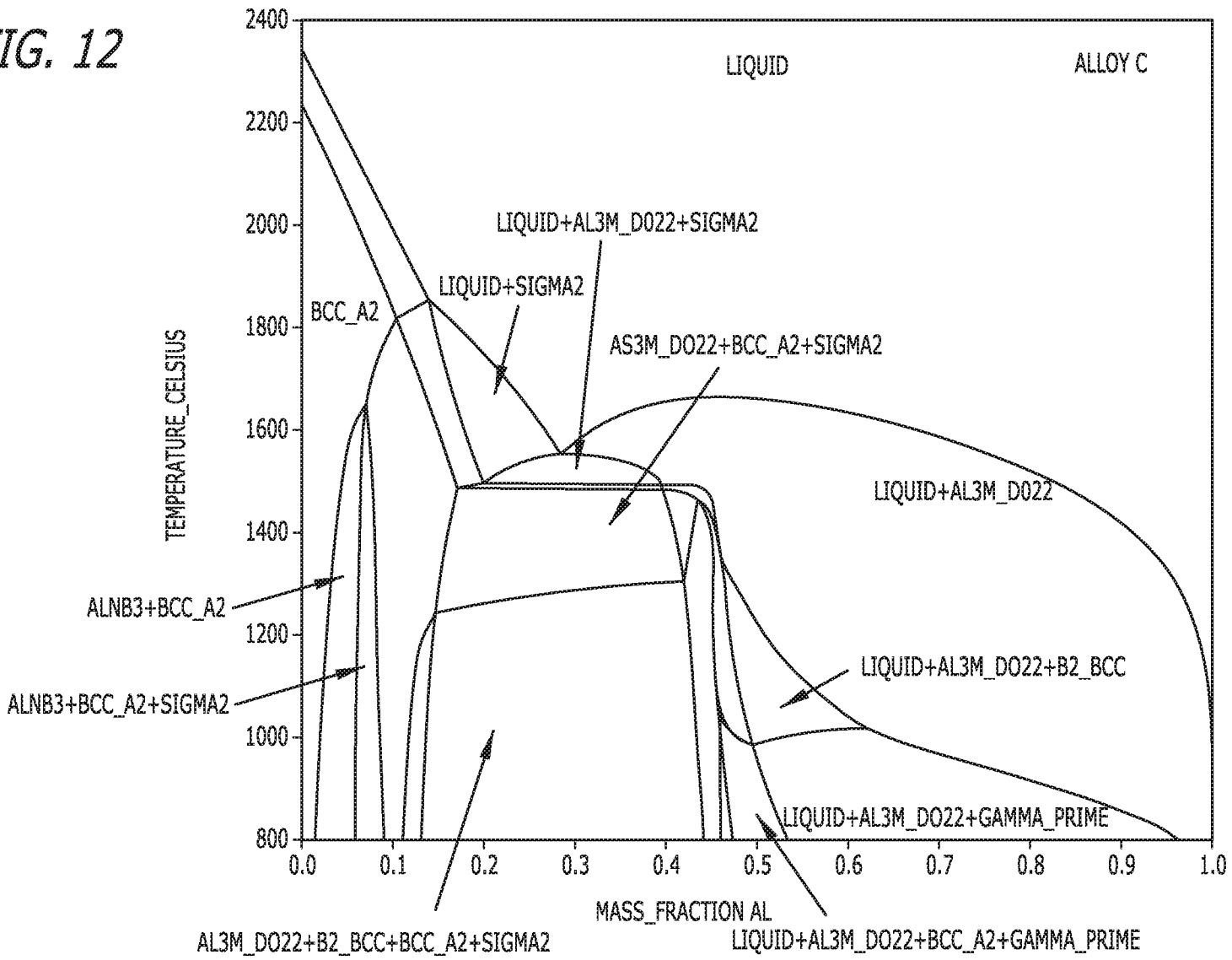
Figure 13:
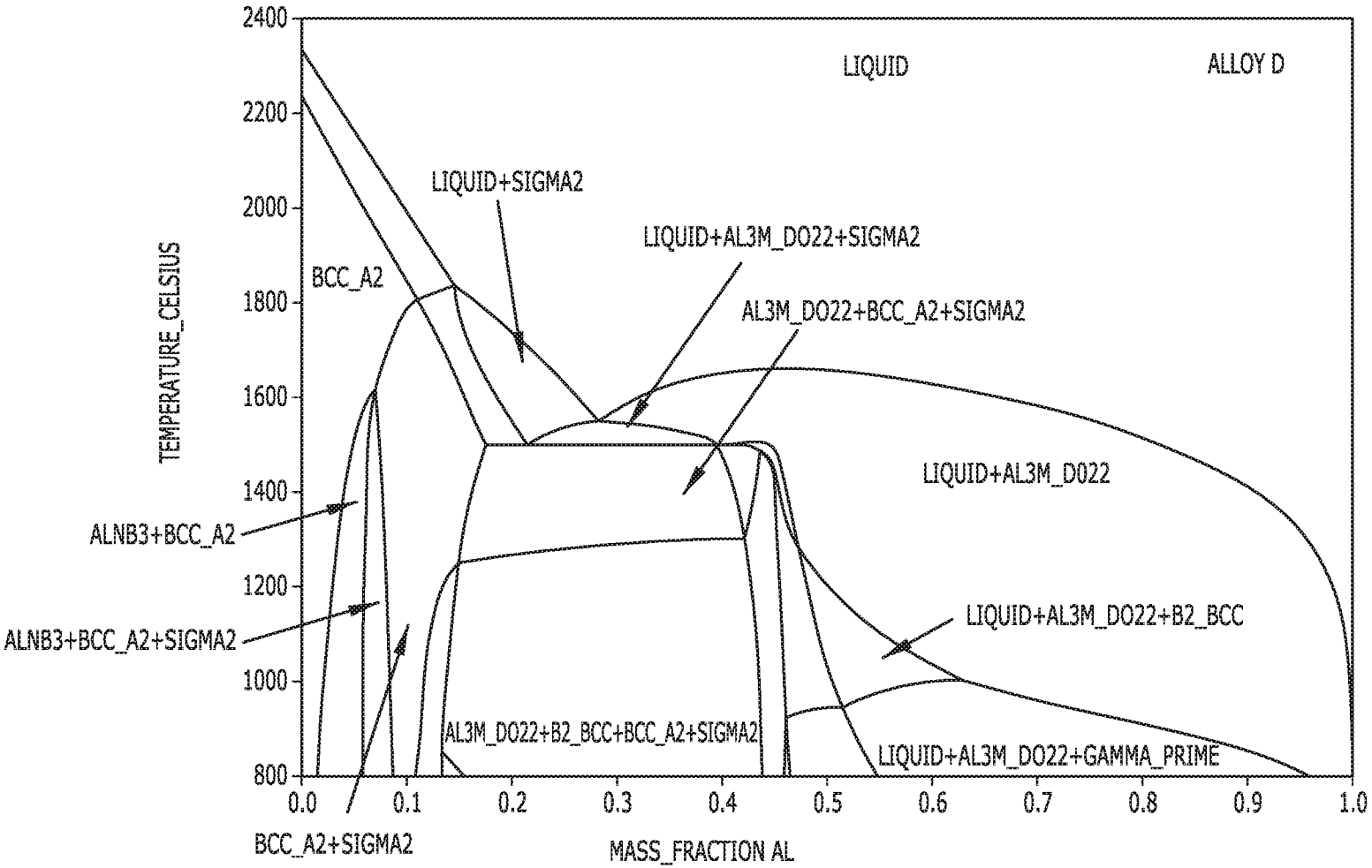
Figure 14:
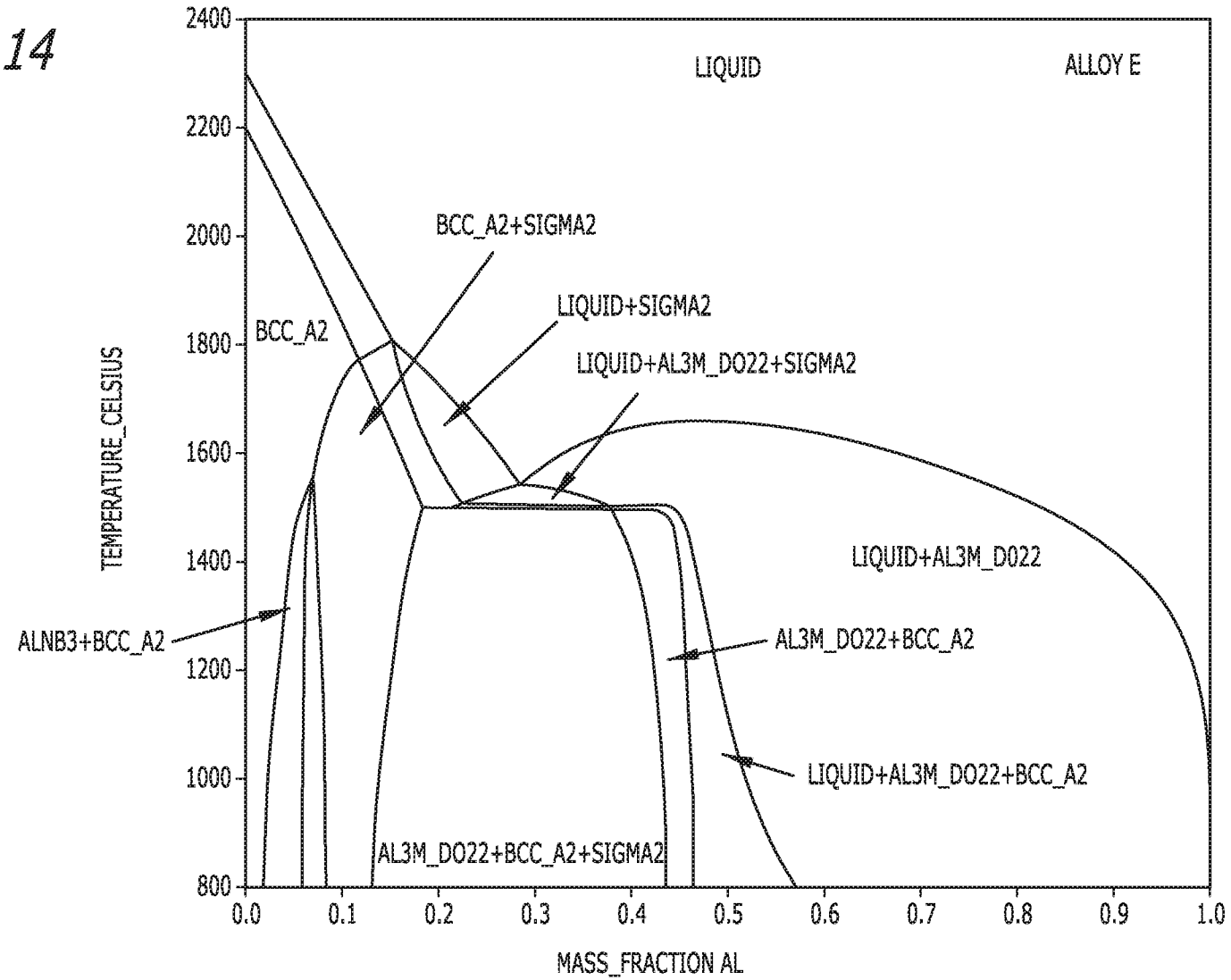

FIG. 2 provides thermogravimetric analysis (TGA) of the alloy sheets with testing at 10° C./min ramp to 1135° C. (2075 F) with full air flow of 250 ml/min and a 1 hour hold. The thermogravimetric analysis results of FIG. 2 show that coating may not be necessary for some alloy compositions in some applications. Therefore, positive test results in the coated application testing in Table 6 above may not be necessary for alloy success.

In the overall testing, positive test results are provided in button IDs 4, 7, 8, 9, 11, 12, and 13.

In one embodiment of the present disclosure, a suitable niobium metal alloy composition has a specific yield strength at 2000° F. of greater than 90 ksi/lb/in^3. In another embodiment of the present disclosure, a suitable niobium metal alloy composition has a specific yield strength at 2000° F. of greater than 100 ksi/lb/in^3. Referring to Table 5, exemplary niobium button alloys have specific yield strength at 2000° F. values of 92.9 ksi/lb/in^3 (ID 4), 103.2 ksi/lb/in^3 (ID 7), 132.0 ksi/lb/in^3 (ID 8), 97.3 ksi/lb/in^3 (ID 9), and 123.4 ksi/lb/in^3 (ID 11).

For comparison, previously developed weldable and cryo-DBTT (ductile-brittle transition temperature) niobium metal alloys all have a specific yield strength at 2000° F. of less than 90 ksi/lb/in^3. For example, Cb752 has a specific yield strength at 2000° F. of 84.46 ksi/lb/in^3, C129Y has a specific yield strength at 2000° F. of 84.84 ksi/lb/in^3, C103 has a specific yield strength at 2000° F. of 54.86 ksi/lb/in^3, FS-85 has a specific yield strength at 2000° F. of 78.1 ksi/lb/in^3.

Example 3

Summary of Test Results for Nb-10.6Hf-7.0V-1.1Ti

An exemplary alloy selection of Nb-10.6Hf-7.0V-1.1Ti achieved the following properties when a 250 gram button was melted and processed to nominal 0.030" sheet for performance evaluation, as described below in Tables 7-9 below.

TABLE 7

Properties of exemplary alloy selection of Nb-10.6Hf-7.0V-1.1Ti

| | |
|---|---|
| Density (lb/in$^3$) | 0.310 lb/in$^3$ (8.58 g/cm$^3$) |
| Grain Size (ASTM #) | 8.1 |
| Vickers Microhardness ($H_V$) | 249.5 |
| TIG Welding | Successful |
| Cryogenic Bend Testing of Welds | Partially Successful, discussed below |
| Coating Diffusion Thickness (microns) | 2.82 μm |
| Final TGA Weight Gain (final mass/%) | 116.2 |

TABLE 8

Testing results of exemplary alloy selection of Nb-10.6Hf-7.0V-1.1Ti

| Testing Temperature | Ultimate Tensile Strength (ksi) | Yield Strength (ksi) | Elongation (%) | Elastic Modulus (Mpsi) |
|---|---|---|---|---|
| 70° F. | 102.8 | 85.4 | 24.1 | 15.3 |
| 2000° F. | 47.3 | 40.9 | 29.7 | 10.5 |
| 2400° F. | 19.2 | 19.2 | 63.4 | 11.6 |

TABLE 9

Testing results of exemplary alloy selection of Nb-10.6Hf-7.0V-1.1Ti

| Testing Temperature | Specific Ultimate Tensile Strength (ksi/lb/in^3) | Specific Yield Strength (ksi/lb/in^3) |
|---|---|---|
| 70° F. | 331.6 (C-103 Alloy = 175.9) | 275.4 (C-103 Alloy = 125.0) |
| 2000° F. | 152.6 (C-103 Alloy = 84.4) | 132.0 (C-103 Alloy = 62.5) |
| 2400° F. | 61.9 | 61.9 |

Example 4

Other Exemplary Niobium Alloy Compositions Including Hafnium

Based on full analysis, the following additional niobium alloy compositions were designed to meet the goals of a potential niobium metal alloy.

TABLE 10

Modeled analysis of exemplary niobium alloy selections

| Wt % | Hf | Zr | Ti | W | V | Mo | Density (lb/in$^3$) | 2000° F. Strength (ksi) | 2000° F. Spec TYS | RT Spec TYS | VHN | Freezing Range (° C.) | Max DBTT (° C.) |
|---|---|---|---|---|---|---|---|---|---|---|---|---|---|
| A | 10 ± 1 | 0.5 ± 0.1 | 1 ± 0.2 | | 3.5 ± 0.4 | | 0.3125-0.317 | 44<br>41-47 | 139<br>130-149 | 265<br>252-279 | 223<br>214-232 | 307<br>287-324 | −196 |
| B | 10 ± 1 | | 1 ± 0.2 | | 6 ± 0.5 | | 0.3102-0.3146 | 52<br>59-55 | 168<br>158-177 | 294<br>282-305 | 240<br>232-248 | 319<br>311-326 | −196 |
| C | 10 ± 1 | 0.5 ± 0.1 | 1 ± 0.2 | 1.5 ± 0.2 | 3.5 ± 0.4 | | 0.3146-0.320 | 47<br>43-50 | 147<br>137-157 | 303<br>286-317 | 249<br>238-259 | 318<br>295-335 | −196 |
| D | 10 ± 1 | 0.5 ± 0.1 | | | 4.8 ± 0.5 | 0.5 ± 0.1 | 0.314-0.3177 | 47<br>44-51 | 150<br>140-161 | 301<br>285-316 | 247<br>236-257 | 297<br>285-307 | −196 |
| E | 10 ± 1 | | | | 6.5 ± 0.7 | | 0.3121-0.316 | 52<br>48-56 | 167<br>154-178 | 279<br>265-289 | 231<br>222-238 | 297<br>291-300 | −196 |
| | | | Goal | | | | — | — | ≥136 | ≥214 | — | ≥325 | −196 |

In one embodiment of the present disclosure, a suitable niobium metal alloy composition has a ductile-brittle transition temperature of less than −196° C. (−321° F.). Referring to Table 10, modeled analysis of exemplary niobium alloys each have a ductile-brittle transition temperature of less than −196° C. (−321° F.).

FIGS. 3-7 summarize the calculated step diagrams for each of the compositions A-E listed above in Table 10 (all with typical interstitial levels of 50 ppm C, 25 ppm N, and 120 ppm O), showing the major phases that form and their phase fractions as a function of temperature. As shown, in all cases the primary phase is the BCC-Nb matrix, which contains the majority of W, Mo, V and Hf in solution. Interstitial elements C, N, and O result in the formation of complex cubic carbides as a grain pinning dispersion (MX type, where M=Hf,Ti,Zr and X=C,N,O; exact compositions vary with the different designs), cubic nitrides (primarily TiN) as an additional nitrogen gettering dispersion when Ti is present, and $HfO_2$ oxide as an oxygen gettering dispersion. Though there is some variance between the designs, the grain pinning carbide dispersion typically has a solvus temperature around 1500° C. and a phase fraction of 0.1% at 1093-1204° C. (2000-2200° F.; recrystallization temperature range). Phase fractions of the carbides are also maintained at >0.08% up to 1316° C. (2400° F.); equivalent to the phase fraction of C-103) to ensure a stable dispersion up to the peak temperature during service. As intended, no designs show formation of $M_2C$ hexagonal carbides, which is shown in literature to be embrittling in Nb.

In all cases, Ti is a primary nitrogen getter, and Hf is the primary oxygen getter. The high level of Hf is sufficient to ensure a low level of soluble oxygen in all designs. As previously described, Ti effectively getters nitrogen from the matrix. However, several designs (D and E) do not contain Ti. While nitrogen is still gettered by the MX carbide dispersion in these alloys, the soluble nitrogen content in the matrix is higher and thus represents greater risk in terms of interstitial embrittlement than the other designs.

FIGS. 3-8 are directed to step diagrams for each concept alloy and baseline C-103, showing the stables phases and their fractions as a function of temperature.

For alloy design, compatibility with the aluminide coating means new alloys should not show substantial deviation from the thermodynamics of the C-103-aluminide coated system. After an aluminide coating is applied and the system heat treated at a temperature in the range of about 1800 F to 1950° F., with the system including the base metal, followed by an inter-diffusion layer of predominantly $Nb_3Al$ phase, which is followed by on outer layer.

To address thermodynamic compatibility, thermodynamic stability was calculated for each alloy system with aluminum, using C-103 (Nb-10Hf-1Ti) as a baseline for comparison.

FIGS. 9-14 are directed to pseudo-binary phase diagrams showing the phase stability as a function of aluminum content for each alloy concept in Table 10 and baseline C-103. Note: aluminide coating is applied at about 1870° F. Therefore, 1870° F. is a primary temperature of interest.

The analysis indicates that all the potential alloys begin with the formation of $Nb_3Al$ in equilibrium with the BCC-Nb matrix at low aluminum contents. Following is the formation of BCC-Nb+$NbAl_3$+$Nb_2Al$ ("Sigma") for C-103 and high-V Alloys B and E; and additionally NbAl ("B2") for the lower V content Alloys A, C and D. While this phase stability window dominates much of the aluminum range according to equilibrium predictions, it is likely that the limited diffusion of Nb during the short aluminizing treatment will restrict the thickness of this condition in favor of just $NbAl_3$ formation (which dominates the end of the sequence in all alloys and baseline C-103).

While the relative amounts of $Nb_2Al$ and NbAl formation vary among the designs, these are only minor phase fractions relative to the $Nb_3Al$ and $NbAl_3$ phases that are dominant in all alloys and baseline C-103. Further, the only new phase that forms is the NbAl phase in Alloys A, C and D, while the rest of the constituents are also present in the C-103 baseline. Since this phase forms in the predominantly $NbAl_3$ sacrificial layer, it would not be expected that this extra phase will negatively impact the ductility of the base metal. The sequence of aluminide formation at low Al contents is consistent with baseline C-103 in all concept alloys. Therefore, the predictions suggest the concept alloys will successfully coat with similar results to the baseline C-103.

While illustrative embodiments have been illustrated and described, it will be appreciated that various changes can be made therein without departing from the spirit and scope of the disclosure.

The embodiments of the disclosure in which an exclusive property or privilege is claimed are defined as follows:

1. A niobium metal alloy composition, comprising:

a vanadium content in the range of 5.75 to about 12 weight percent, a hafnium content in the range of about 5 to about 13 weight percent, a titanium or zirconium content or a mixture of titanium and zirconium content in the range of about 0.25 to about 2.5 weight percent; and a niobium content of about 77 to about 85 weight percent.

2. The niobium metal alloy composition of claim 1, wherein the vanadium content is 6 to about 12 weight percent.

3. The niobium metal alloy composition of claim 1, wherein the hafnium content is in a range selected from the group consisting of greater-than-5 to about 13 weight percent.

4. The niobium metal alloy composition of claim 2, wherein the titanium or zirconium content or a mixture of titanium and zirconium content is in a range selected from the group consisting of about 0.5 to about 2.0 weight percent.

5. The niobium metal alloy composition of claim 4, further comprising another alloying metal selected from the group consisting of tungsten, molybdenum, tantalum, rhenium, and combinations thereof.

6. The niobium metal alloy composition of claim 4, wherein the alloy has a ductile-brittle transition temperature of less than −196° C. (−321° F.).

7. The niobium metal alloy composition of claim 4, wherein the alloy has a specific yield strength at 2000° F. of greater than 90 ksi/lb/in$^3$.

8. The niobium metal alloy composition of claim 4, wherein the alloy has a specific yield strength at 2000° F. of greater than 100 ksi/lb/in$^3$.

9. The niobium metal alloy composition of claim 1, wherein the vanadium content is 6 to about 9 weight percent;

the hafnium content is about 8 to about 13 weight percent; or the titanium or zirconium content or a mixture of titanium and zirconium is about 0.7 to about 1.5 weight percent.

10. A niobium metal alloy composition, consisting of:

a vanadium content in the range of about 1.5 to about 12 weight percent;

a hafnium content in the range of about 5 to about 13 weight percent;

a titanium or zirconium content or a mixture of titanium and zirconium content in the range of about 0.25 to about 2.5 weight percent; and a niobium content as a balance of the alloy.

11. The niobium metal alloy composition of claim 10, wherein the niobium content is in a range selected from the group consisting of about 70 to about 90 weight percent.

12. The niobium metal alloy composition of claim 10, wherein the vanadium content is in a range selected from the group consisting of about 2 to about 12 percent.

13. The niobium metal alloy composition of claim 10, wherein the hafnium content is in a range selected from the group consisting of greater-than-5 to about 13 weight percent.

14. The niobium metal alloy composition of claim 10, wherein the titanium or zirconium content or a mixture of titanium and zirconium content is in a range selected from the group consisting of about 0.5 to about 2.0 weight percent.

15. The niobium metal alloy composition of claim 10, wherein the alloy has a ductile-brittle transition temperature of less than −196° C. (−321° F.).

16. The niobium metal alloy composition of claim 10, wherein the alloy has a specific yield strength at 2000° F. of greater than 90 ksi/lb/in$^3$.

17. The niobium metal alloy composition of claim 10, wherein the alloy has a specific yield strength at 2000° F. of greater than 100 ksi/lb/in$^3$.

18. A niobium metal alloy composition of claim 10, wherein the niobium content is about 77 to about 85 weight percent;

the vanadium content is about 5 to about 12 weight percent;

the hafnium content is about 8 to about 13 weight percent; or the titanium or zirconium content or a mixture of titanium and zirconium content is about 0.7 to about 1.5 weight percent.

* * * * *